US006767000B2

(12) United States Patent
Heide

(10) Patent No.: US 6,767,000 B2
(45) Date of Patent: Jul. 27, 2004

(54) MANUFACTURING PLATFORM

(76) Inventor: Poul Heide, 4125 South St., Titusville, FL (US) 32780

( * ) Notice: Subject to any disclaimer, the term of this patent is extended or adjusted under 35 U.S.C. 154(b) by 201 days.

(21) Appl. No.: 10/178,679

(22) Filed: Jun. 24, 2002

(65) Prior Publication Data

US 2003/0234339 A1 Dec. 25, 2003

(51) Int. Cl.[7] ..... B28B 15/00

(52) U.S. Cl. ..... 249/205; 249/120; 249/137; 249/161; 249/170; 249/171; 425/62; 425/432; 425/439

(58) Field of Search ..... 249/33, 120, 137, 249/139, 161, 170, 171, 205; 425/62, 424, 432, 439

(56) References Cited

U.S. PATENT DOCUMENTS

| | | | | |
|---|---|---|---|---|
| 3,724,805 A | * | 4/1973 | Kleiber et al. | 249/171 |
| 5,023,030 A | | 6/1991 | Rantanen | |
| 5,035,592 A | | 7/1991 | Lowndes, III et al. | |
| 5,329,742 A | | 7/1994 | Lee | |
| 5,354,189 A | | 10/1994 | McKinnon | |
| 5,490,367 A | | 2/1996 | Lee | |
| 5,520,531 A | | 5/1996 | Del Monte | |
| 5,524,861 A | | 6/1996 | Solomon | |
| 5,533,888 A | | 7/1996 | Belarde | |
| 5,616,349 A | | 4/1997 | Sasaki | |

FOREIGN PATENT DOCUMENTS

FR 2538750 A1 * 7/1984

* cited by examiner

*Primary Examiner*—James P. Mackey
*Assistant Examiner*—Donald Heckenberg

(57) ABSTRACT

A manufacturing platform has one or more tables for producing construction components such as walls, floors, decks and roofs. The tables are pivotally mounted on second and/or third axes at the outboard edges or rear end of a pair of rectangular horizontal frames which are pivotally mounted on first axes on either side of a trailer. Actuating means tilts each table outward about the second axis or rearward about the third axis to an upright position for removal of the finished construction components, and tilts each table and corresponding frame together inward about the first axis to an upright storage position for trailer transport. Locking means secures and releases the tables to the frames. A first axis support is either the trailer or a foundation affixed to a floor. A second support at the outboard edge of the frame is selectively variable in height to level the table.

20 Claims, 7 Drawing Sheets

MANUFACTURING PLATFORM

The present invention relates generally to construction equipment and pertains, more specifically, to a construction component manufacturing platform upon which custom or standard parts can be produced for a building or structure. The invention can be configured as a stationary or mobile platform equipped with a plurality of manufacturing tables, each fitted with a lifting mechanism and optional vibrators and heaters.

Heretofore, construction components have been fabricated on site in a variety of ways. Wood components are assembled one piece at a time either in their finished position, or on the uneven ground, or on a construction site cluttered with debris. This is laborious, and sometimes even dangerous. Every component is custom made, even if multiple dwellings are to be built identically. Concrete components are made by erecting molds in place and pouring concrete into the molds. Each mold is essentially custom made for the job, and is disassembled afterward. The process is labor intensive and inefficient. Previous construction techniques have not been able to overcome these problems, as shown in the following U.S. patents:

Solomon, U.S. Pat. No. 5,524,861, shows a system of panels forming a mold for casting an entire outer wall of a building in one piece; Del Monte, U.S. Pat. No. 5,520,531, discloses a portable, heated mold for forming concrete wall segments; Sasaki, U.S. Pat. No. 5,616,349, reveals a mold, variable in height, for forming a horizontal concrete slab; and Lee, U.S. Pat. Nos. 5,329,742, and 5,490,367, depict an apparatus for supporting and moving vertically a mold for forming the walls of a building.

While the prior art devices are functional in the construction of concrete walls or slabs, none of them are versatile enough to be used with either concrete, wood, or metal construction. Nor can any be used to form outside or inside walls that are completely finished on both sides, including studs, liners, plates, corners, sheathing, and lintels over windows and doors. Nor can they provide for walls complete with fiberglass or foam insulation, piping, electrical wiring and outlets, and paneling or drywall ready for decorative finish. None can be used to fabricate floor panels, decks, and roof panels. They cannot be utilized to form walls of brick, stone, stucco, or block, with different aggregates in the same wall.

SUMMARY OF THE INVENTION

The present invention provides a platform for the manufacture of finished construction components made from any material. The platform can be fixed to a foundation in a plant, and used in a stationary mode. In this manner, it can be utilized to produce all kinds of products including building and structural components.

The platform can just as well be mounted on a trailer and towed with a truck tractor to a construction site with the platform table or tables in the raised, storage position, facing inward on the trailer. At the site, the table or tables are lowered into the horizontal, operative position and leveled. There, concrete forms are set up on the platform table, the forms being made from steel, aluminum, wood, plastic, or other like rigid materials. Outside surface materials, for example brick, are placed on the flat table surface, thus defining the outside wall surface. Reinforcing bars are placed in the forms, along with electrical conduit, plumbing, lintels over openings, and other structural elements. After pouring concrete, insulation and interior surfaces are installed. When the concrete is set, the locking means is released, and the platform table is raised into the discharge position facing outward on the trailer. The wall component, now erect, is then lifted from the platform and set into place in the building. In the case of wood construction, fixtures may be attached to the table surface to position various components. Outside sheathing is placed on the table surface, then the plate, studs, headers, liners, etc., are added. Windows and doors can be installed at this point. Electrical conduits and outlets are added next, along with plumbing, then insulation. Interior paneling or sheetrock is installed last. The table is then raised as before, and the wall is removed. In a similar manner, roof panels, floors, decks, stairs, railings, and architectural embellishments can be quickly, safely, and efficiently produced.

The above features, as well as further features and advantages, are attained by the present invention which may be described briefly as a manufacturing platform comprising a table having upper and lower surfaces extending between opposite first and second edges and opposite front and rear ends. A frame extends between opposite first and second edges. The frame second edge and rear edge pivotally attaches to the table adjacent the table second edge or at the rear edge between the first and second edges for supporting the table and allowing the table to pivot about a second axis or a third axis. Locking means are included for selectively locking the table to the frame to prevent pivotal movement of the table about the second axis or third axis, and releasing the table from the frame to allow pivotal movement of the table about the second axis or third axis.

A first support is pivotally attached to the frame adjacent the frame first edge for supporting the frame and allowing the frame to pivot about a first axis. A second support and third support is each attached to the frame adjacent the frame's respective second edge and rear end for supporting the frame.

Actuating means is further included for selectively actuating the table and frame together about the first axis to an upright storage position over the first support and to a substantially horizontal operative position wherein the table is used to manufacture the construction component with the locking means locked.

The actuating means also serves for selectively actuating the table about the second axis or third axis to an upright discharge position for removal of the construction component from the table as well as to the substantially horizontal operative position, at which the table is closely juxtaposed and substantially parallel with the frame with the locking means released.

BRIEF DESCRIPTION OF THE DRAWINGS

The invention will be more fully understood, while still further features and advantages will become apparent, in the following detailed description of preferred embodiments thereof illustrated in the accompanying drawings, in which.

DESCRIPTION OF THE PREFERRED EMBODIMENTS

Figure 1:
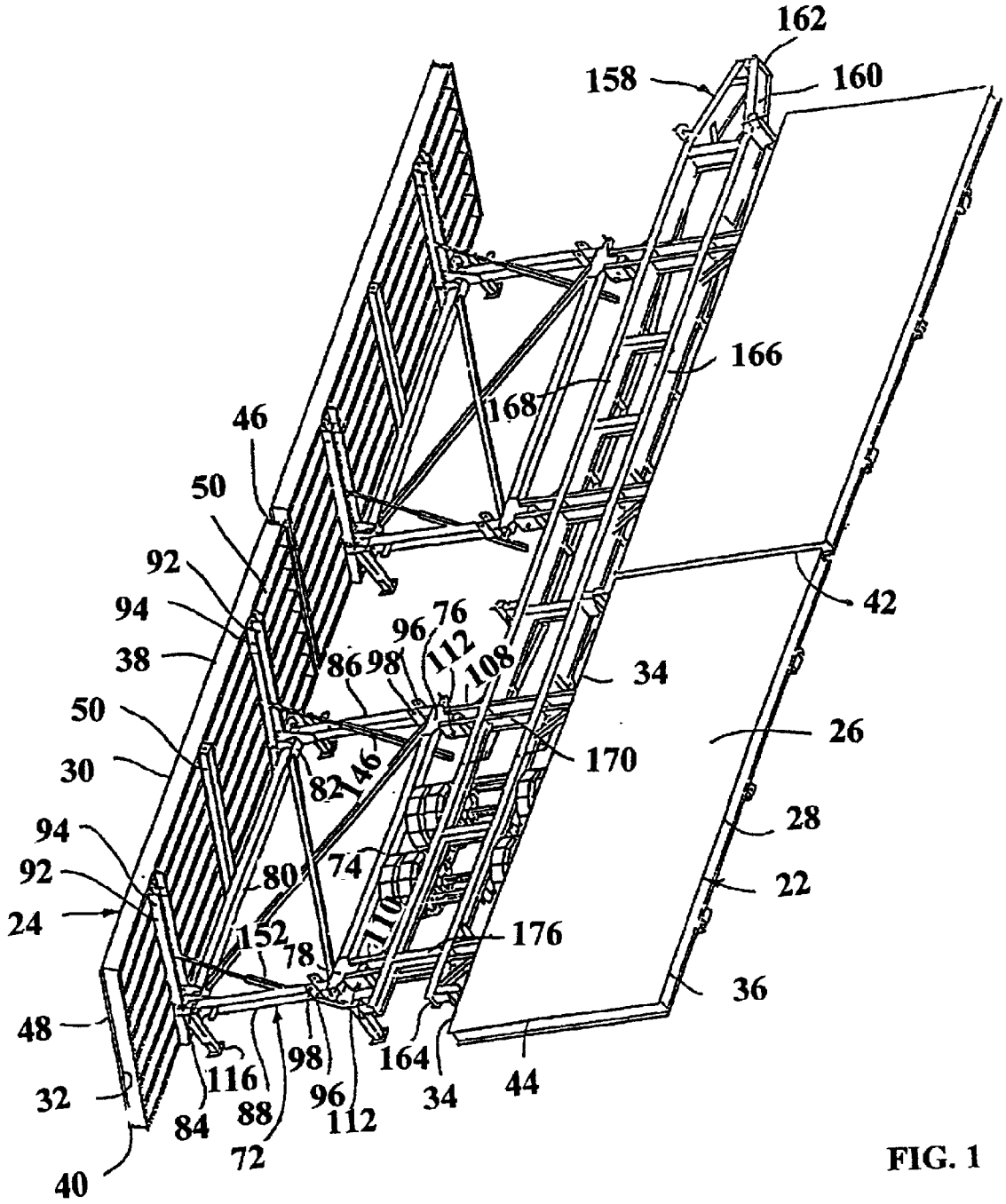
FIG. 1 is a perspective view of a manufacturing platform constructed in accordance with the invention.
Figure 2:
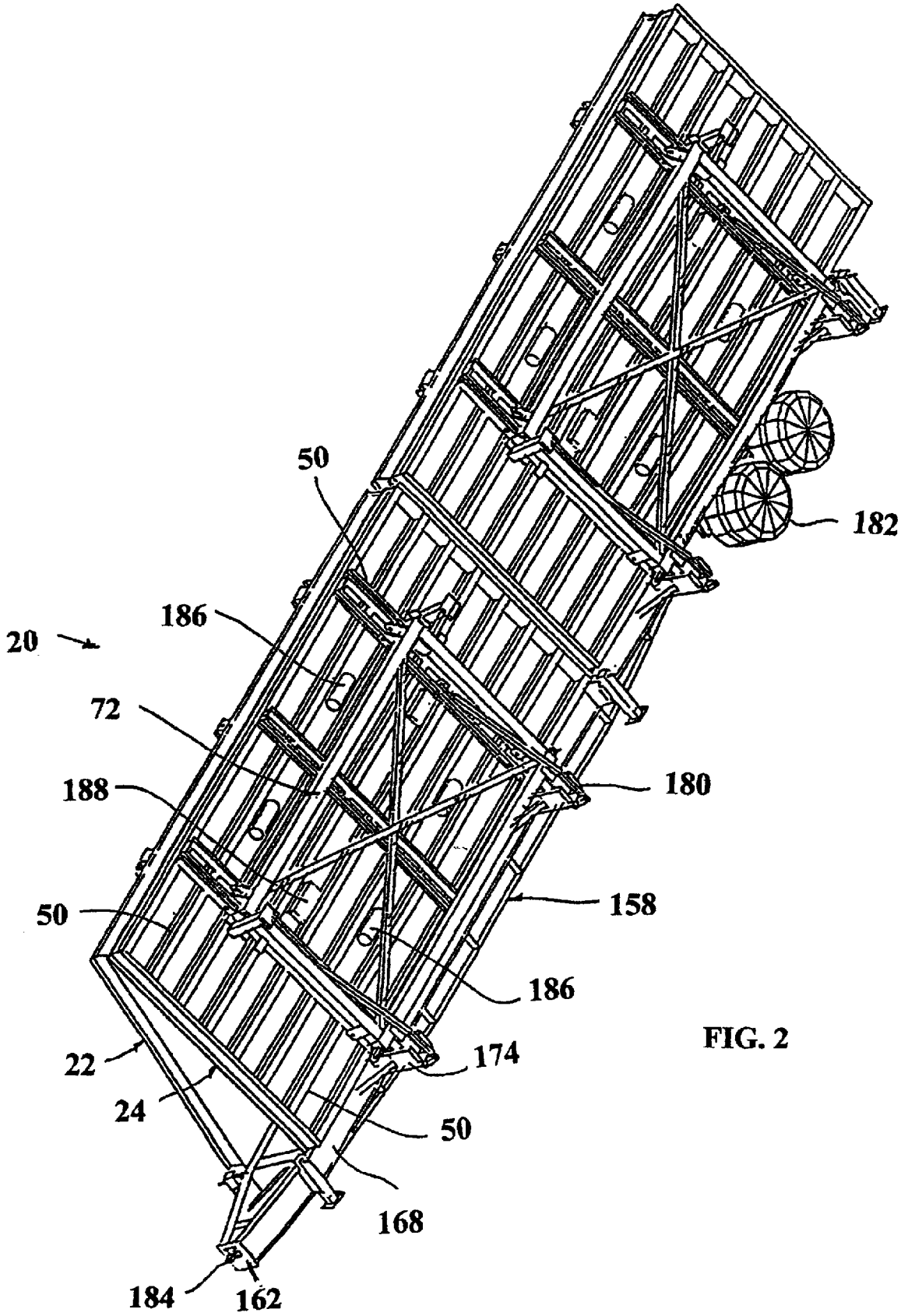
FIG. 2 is another perspective view of the manufacturing platform of FIG. 1.
Figure 3:
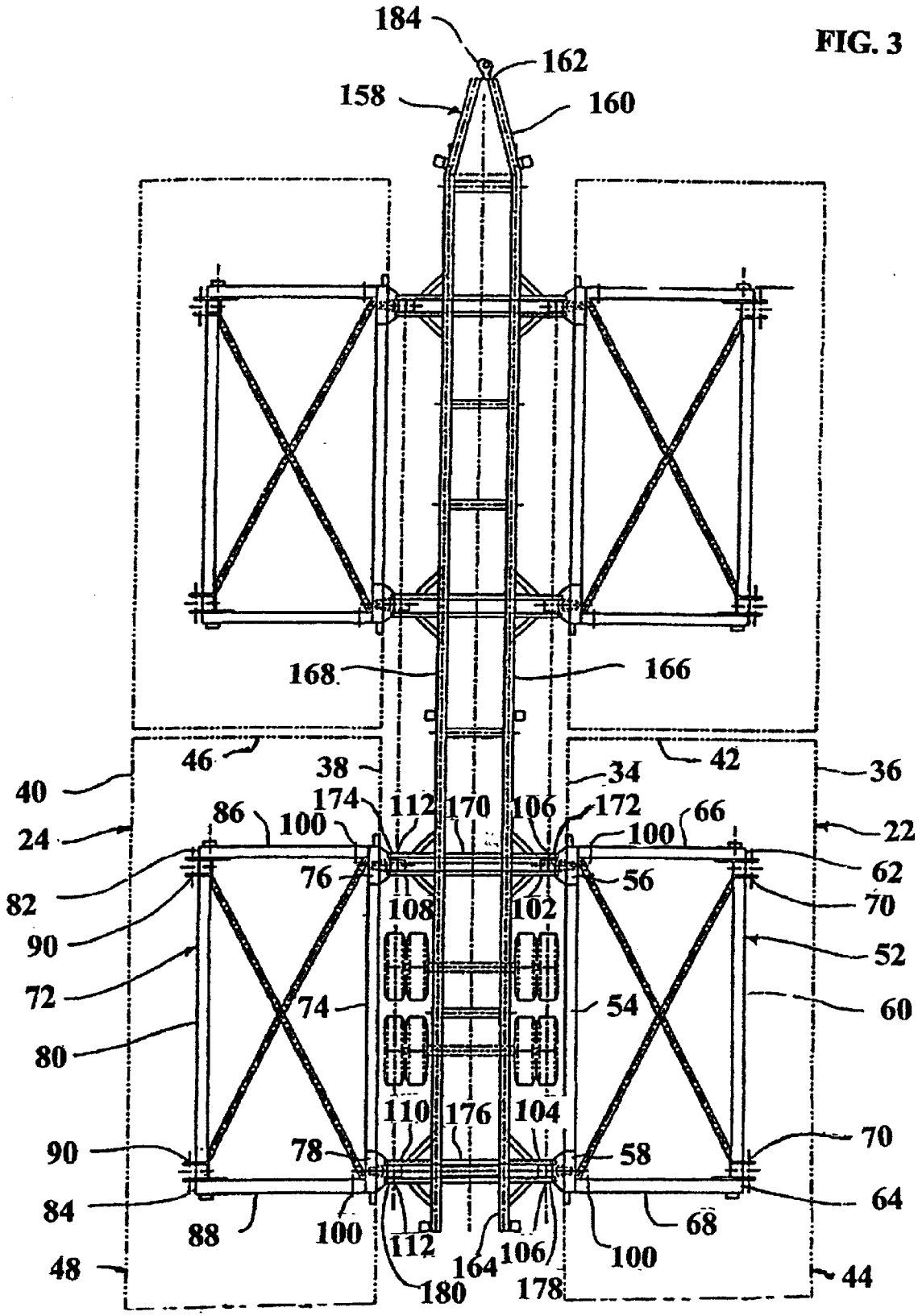
FIG. 3 is a plan view of the manufacturing platform of FIG. 1.

Referring now to the drawing, and especially to FIGS. 1, 2, 3, 4, 5, and 6, a manufacturing platform is shown at 20, and includes one or more tables, single or in pairs, made of steel or aluminum plate. When constructed as one or more pairs, each pair typically includes a right table 22 and a left table 24. Each table has upper and lower surfaces, including a right upper surface 26 and a right lower surface 28, and a left upper surface 30 and a left lower surface 32. The surfaces extend between opposite first and second edges, including a right first edge 34 and a right second edge 36, and a left first edge 38 and a left second edge 40, respectively. The surfaces also extend between opposite front and rear ends, including a right front end 42 and a right rear end 44, and a left front end 46 and a left rear end 48, respectively. The right table 22 and the left table 24 each includes a plurality of reinforcing members 50 adjacent the lower surfaces 28 and 32, respectively, to limit deflection of the table surfaces.

The platform further comprises a pair of frames, including a right frame 52 and a left frame 72, for supporting the right table 22 and the left table 24, respectively. Each frame is constructed from four structural members welded together at the comers, forming a rectangle.

The right frame 52 includes a right first edge member 54 extending between opposite front 56 and rear 58 ends, and a right second edge member 60 extending between opposite front 62 and rear 64 ends. The first edge member 54 is spaced apart from and substantially parallel to the second edge member 60. A right front member 66 extends between the first edge member front end 56 and the second edge member front end 62. A right rear member and third axis 68 extends between the first edge member rear end 58 and the second edge member rear end 64. The front member 66 is substantially parallel to the rear member 68. The right frame 52, adjacent the right frame second edge member front end 62 and rear end 64 and the third axis 68 between first edge 58 and second edge 64 and adjacent to the right table rear edge 44, is pivotally attached to the right table 22 adjacent the right table second edge 36 and rear end 44. This pivotal attachment supports the right table 22 in a position closely juxtaposed and substantially parallel with the right frame 52 and allows the right table 22 to pivot about a right second axis 70 or right third axis 68 between first edge 58 and second edge 64 parallel with the rear end of Table 44. The invention incorporates the combination of the second and third axis allowing the table to be pivoted at the axis most suitable for any given construction component.

The left frame 72 includes a left first edge member 74 extending between opposite front 76 and rear 78 ends, and a left second edge member 80 extending between opposite front 82 and rear 84 ends. The first edge member 74 is spaced apart from and substantially parallel to the second edge member 80. A left front member 86 extends between the first edge member front end 76 and the second edge member front end 82. A left rear member 88 extends between the first edge member rear end 78 and the second edge member rear end 84.

The front member 86 is substantially parallel to the rear member 88. The left frame 72, adjacent the left frame second edge member front end 82 and rear end 84, is pivotally attached to the left table 24 adjacent the left table second edge 40 and the third axis 88, between the first edge 78 and second edge 84 and adjacent to the left table rear end 48, for supporting the left table 24 and allowing the left table 24 to pivot about a left second axis 90 or left third axis 88 for supporting the left table 24 and allowing the left table 24 to pivot about a left second axis 90 or left third axis 88. The left frame 72, adjacent the left frame second edge member front end 82 and rear end 84, is pivotally attached to the left table 24 adjacent the left table second edge 40. This pivotal attachment supports the left table 24 in a position closely juxtaposed and substantially parallel with the left frame 72 and allows left table 24 to pivot about a left second axis 90 and rear third axis 88.

Locking means is provided for selectively locking each table to the respective frame, to prevent pivotal movement of each table about the respective second or third axis, and for releasing each table from the respective frame to allow pivotal movement of each table about the respective second axis or third axis.

At least two table locking members 92, are attached to each table 22 and 24, and serve as table locking means. The table locking members 92, typically will be a pair of reinforcing members disposed transversely under each table. Each table locking member 92 has a hole 94 there through adjacent the table first edges 34 and 38 and substantially parallel to the table surfaces 26 and 30. A plurality of frame locking members 96 are provided, typically mounted in pairs to each frame front member 66 and 86, and to each frame rear member 68 and 88, adjacent each frame first edge member 54 and 74 respectively, and projecting outward or rearward toward the corresponding table 22 and 24. Each pair of frame locking members 96 is disposed on either side of one of the table locking members 92, and each frame locking member 96 has a hole 98 therethrough in alignment with the respective table locking member hole 94 when the table is in a position closely juxtaposed and substantially parallel with the respective frame. A plurality of locking pins 100 are provided, including one locking pin 100 engaging each table locking member hole 94 and the corresponding frame locking member hole 98.

A pair of right first supports are provided to support the weight of the table, frame, and construction component near the inboard or first edge of the right table. Included are a front right first support 102 pivotally attached to the right frame 52 adjacent the connection of the first edge member 54 to the front member 66, and a rear right first support 104 pivotally attached to the right frame 52 adjacent the connection of the first edge member 54 to the rear member 68, for supporting the right frame 52 and allowing the right frame to pivot about a right first axis 106. Also provided are a pair of left first supports, to support the weight of the table, frame, and construction component near the inboard or first edge of the left table. Included are a front left first support 108 pivotally attached to the left frame 72 adjacent the connection of the first edge member 74 to the front member 86, and a rear left first support 110 pivotally attached to the left frame 72 adjacent the connection of the first edge member 74 to the rear member 88, for supporting the left frame 72 and allowing the left frame to pivot about a left first axis 112.

A pair of right second supports 114, being selectively variable in height, are used to support the weight of the table, frame, and construction component near the outboard or second edge 36 of the right table 22. One support 114 is attached to the right frame 52 adjacent the connection of the second edge member 60 to the front member 66, and one support 114 is attached to the right frame 52 adjacent the connection of the second edge member 60 to the rear member 68, for supporting the right frame 52. A pair of left second supports 116, being selectively variable in height, are used to support the weight of the table, frame, and construction component near the outboard or second edge 40 of the left table 24. One support 116 is attached to the left frame 72 adjacent the connection of the second edge member 80 to the front member 86, and one support 116 is attached to the left frame 72 adjacent the connection of the second edge member 80 to the rear member 88, for supporting the left frame 72.

The supports can take any number of forms, including scissor jacks, screw jacks, hydraulic cylinders, etc., or telescoping tubes as described next.

Each support of the pair of right 114 and left 116 second supports includes a first tubular member 113 having at least one transverse hole. A second tubular member 115 slideably engages the first tubular member 113. The second tubular member 115 has a plurality of transverse holes spaced apart longitudinally. A support pin 117 selectively engages one of the holes in each of the first 113 and second 115 tubular members, in order to adjust the table to a level operating position.

Figure 4:
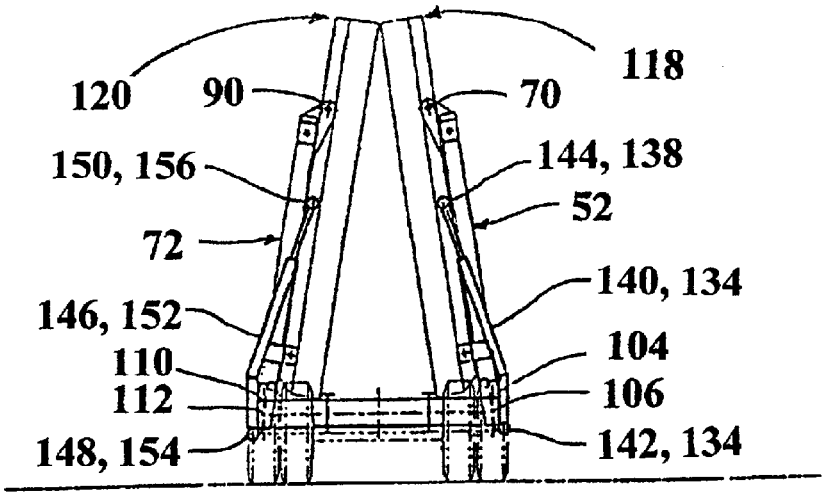
FIG. 4 is a rear elevation view of the manufacturing platform of FIG. 1.
Figure 5:
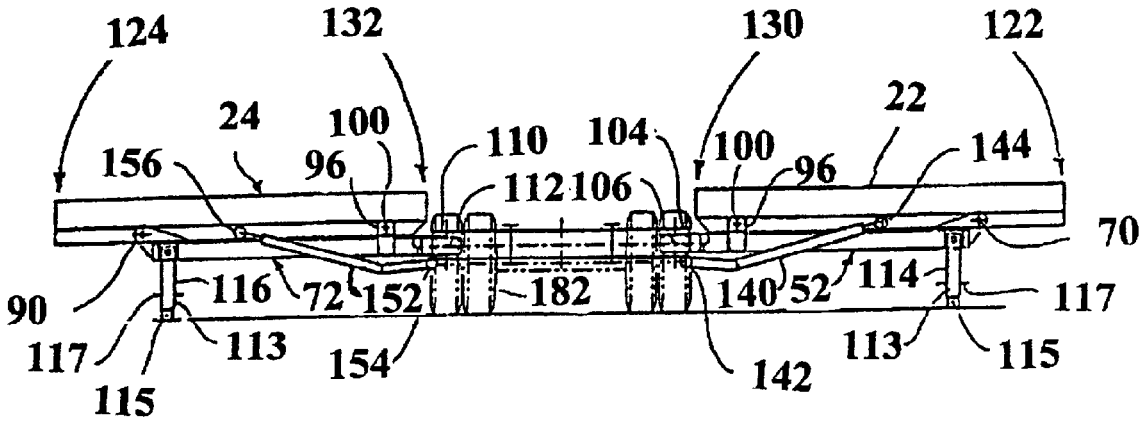
FIG. 5 is a rear elevation view of the manufacturing platform of FIG. 1, showing another aspect of the invention.
Figure 6:
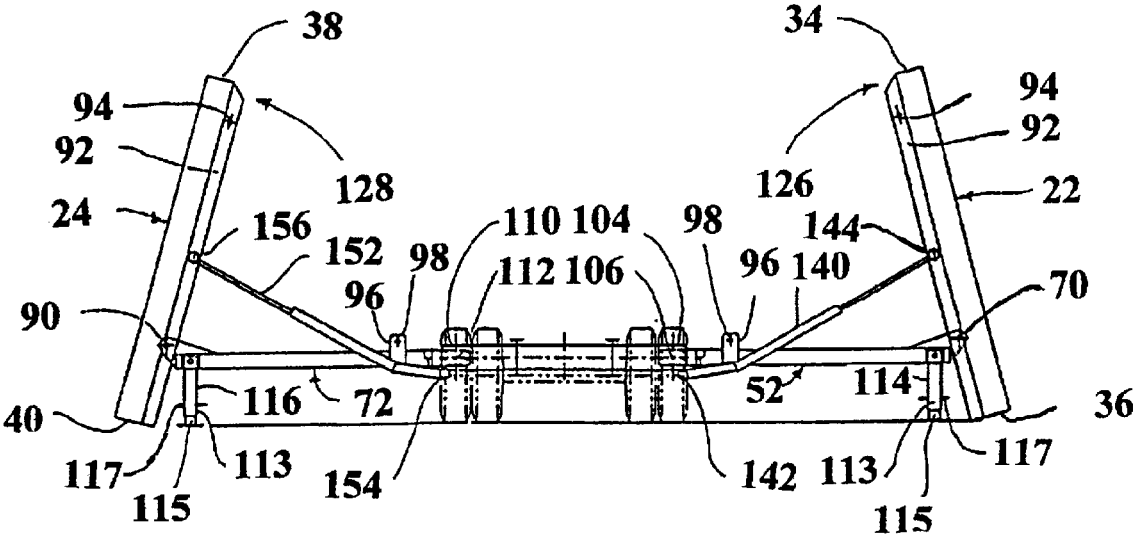
FIG. 6 is a rear elevation view of the manufacturing platform of FIG. 1, showing a further aspect of the invention.

The platform includes a front right linear actuator 134, and a rear right linear actuator 140, which serve as right actuating means for selectively actuating or lifting the right table 22 and right frame 52 together in an arcing motion about the right first axis 106 to an upright storage position over the right first supports 102 and 104, as shown by arrow 118 in FIG. 4. The table must be secured to the frame with the locking means locked. In the storage position, the tables and frames can be transported over the road to the job site. The right actuating means also actuates or lowers the right table 22 and right frame 52 together from the storage position to a substantially horizontal operative position, as shown by arrow 122 in FIG. 5. Again, the locking means must be locked. In the operative position, the right table 22 will be used to manufacture the construction component, as described above. The same right actuating means is used for selectively actuating or lifting the right table 22 about the right second axis 70, to an upright discharge position over the right second supports 114, as shown by arrow 126 in FIG. 6. With the locking means released, as it now must be, the actuating means is no longer compelled to lift the combined weight of the table and frame, but only that of the table, which is semi-balanced. Thus, the frame remains on the ground and the table rises, this time in the other direction. In the discharge position, the construction component will be removed from the right table. The right actuating means also actuates or lowers the right table 22 to the substantially horizontal operative position as shown by arrow 130 in FIG. 5. The locking means remains released as the right table 22 is lowered back into the operative position closely juxtaposed and substantially parallel with the right frame 52.

The platform also includes a front left linear actuator 146, and a rear left linear actuator 152, which serve as left actuating means for selectively actuating or lifting the left table 24 and left frame 72 together in an arcing motion about the left first axis 112 to an upright storage position over the left first supports 108 and 110, as shown by arrow 120 in FIG. 4. The table must be secured to the frame with the locking means locked. The left actuating means also actuates or lowers the left table 24 and left frame 72 together from the storage position to a substantially horizontal operative position, as shown by arrow 124 in FIG. 5. Again, the locking means must be locked. In the operative position, the left table 24 will be used to manufacture the construction component, as described above. The same left actuating means is used for selectively actuating or lifting the left table 24 about the left second axis 90, to an upright discharge position over the left second supports 116, as shown by arrow 128 in FIG. 6. The locking means is now released. With the table now in the discharge position, the construction component will be removed from the left table. The left actuating means also actuates or lowers the left table 24 to the substantially horizontal operative position as shown by arrow 132 in FIG. 5. The locking means remains released as the left table 24 is lowered back into the operative position closely juxtaposed and substantially parallel with the left frame 72.

The linear actuators typically will be either hydraulic cylinders or electric motor driven screw type actuators, although other type actuators can be utilized.

The front right linear actuator 134 has opposite first 136 and second 138 ends, and the rear right linear actuator 140, has opposite first 142 and second 144 ends. The front right linear actuator first end 136 is pivotally attached to the front right first support 102 below the right first axis 106. The front right linear actuator second end 138 is pivotally attached to the right table 22 intermediate the first 34 and second 36 edges. The rear right linear actuator first end 142 is pivotally attached to the rear right first support 104 below the right first axis 106. The rear right linear actuator second end 144 is pivotally attached to the right table 22 intermediate the first 34 and second 36 edges.

The front left linear actuator 146 has opposite first 148 and second 150 ends, and the rear left linear actuator 152, has opposite first 154 and second 156 ends. The front left linear actuator first end 148 is pivotally attached to the front left first support 108 below the left first axis 112. The front left linear actuator second end 150 is pivotally attached to the left table 24 intermediate the first 38 and second 40 edges. The rear left linear actuator first end 154 is pivotally attached to the rear left first support 110 below the left first axis 112. The rear left linear actuator second end 156 is pivotally attached to the left table 24 intermediate the first 38 and second 40 edges.

The mobile version of the manufacturing platform includes a trailer, which serves as the pair of right first supports and the pair of left first supports. The trailer 158 comprises a chassis 160 extending longitudinally between opposite front 162 and rear 164 ends, the chassis having two longitudinal girders, including a right girder 166 and a left girder 168. Two beams are attached to the girders transversely, including a front beam 170 extending between the girders and projecting outward from the right girder 166 to a right front beam end 172, and projecting outward from the left girder 168 to a left front beam end 174. Also included is a rear beam 176 extending between the girders and projecting outward from the right girder 166 to a right rear beam end 178, and projecting outward from the left girder 168 to a left rear beam end 180, with the right front 172 and right rear 178 beam ends pivotally engaging the right frame 52 on the right first axis 106, and the left front 174 and left rear 180 beam ends pivotally engaging the left frame 72 on the left first axis 112. The trailer 158 includes an axle with wheels and tires 182, mounted to the chassis 160 adjacent the chassis rear end 164. Also included is a hitch 184 mounted on the chassis front end 162.

An optional feature of the platform is a plurality of vibrators 186 attached to the lower surfaces of each table to aid the concrete in flowing into recesses in the mold, and to consolidate concrete by eliminating air pockets.

Another optional feature of the platform is a plurality of heaters 188 attached to the lower surfaces of each table for reducing concrete curing time.

Figure 7:
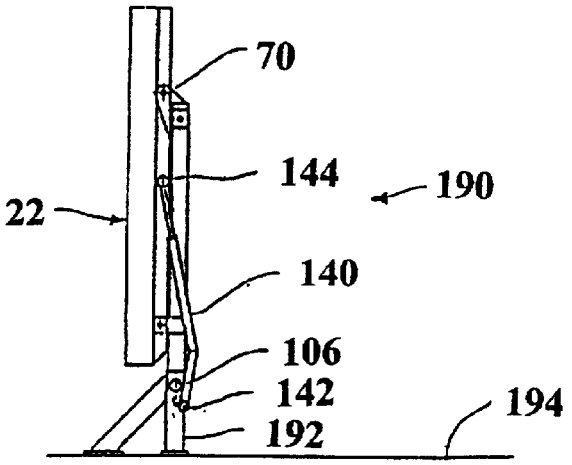
FIG. 7 is a rear elevation view of another manufacturing platform constructed in accordance with the invention.
Figure 8:
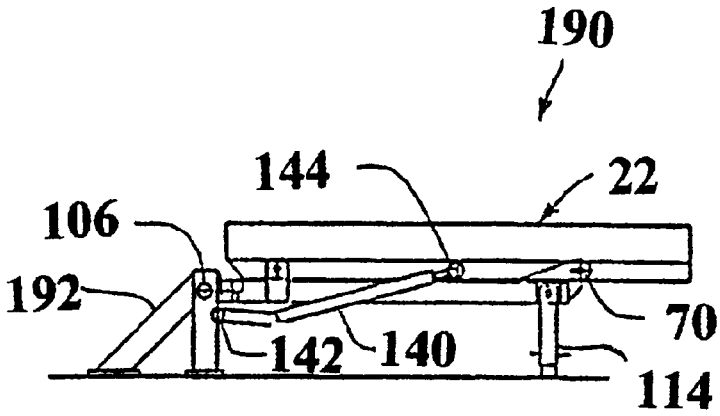
FIG. 8 is a rear elevation view of the manufacturing platform of FIG. 7, showing another aspect of the invention.
Figure 9:
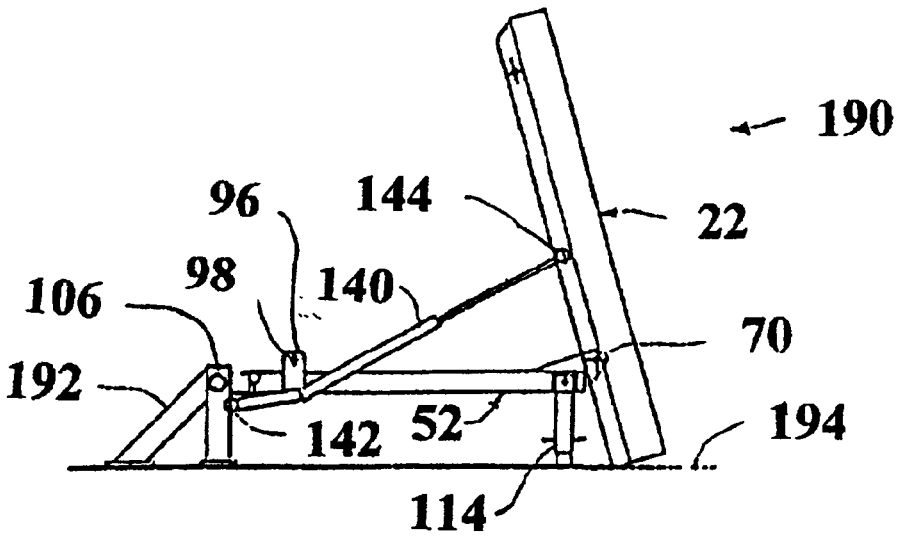
FIG. 9 is a rear elevation view of the manufacturing platform of FIG. 7, showing a further aspect of the invention.

Turning now to FIGS. 7, 8, and 9, another manufacturing platform constructed in accordance with the invention is shown at 190. This platform is stationary and differs from the mobile platform described above only in details of the first supports. Therefore, the same part numbers and accompanying descriptions will be used as for the right-hand portions of the mobile platform.

A pair of stationary first supports 192 are provided to support the weight of the table, frame, and construction component near the inboard or first edge of the right table. Included are a stationary first support 192 pivotally attached to the frame 52 adjacent the connection of the first edge member 54 to the front member 66, and a stationary first support 192 pivotally attached to the frame 52 adjacent the connection of the first edge member 54 to the rear member 68, for supporting the frame 52 and allowing the frame to pivot about a first axis 106.

The stationary first supports 192 are typically affixed to the floor 194 of a manufacturing facility for permanent production work.

Figure 10:
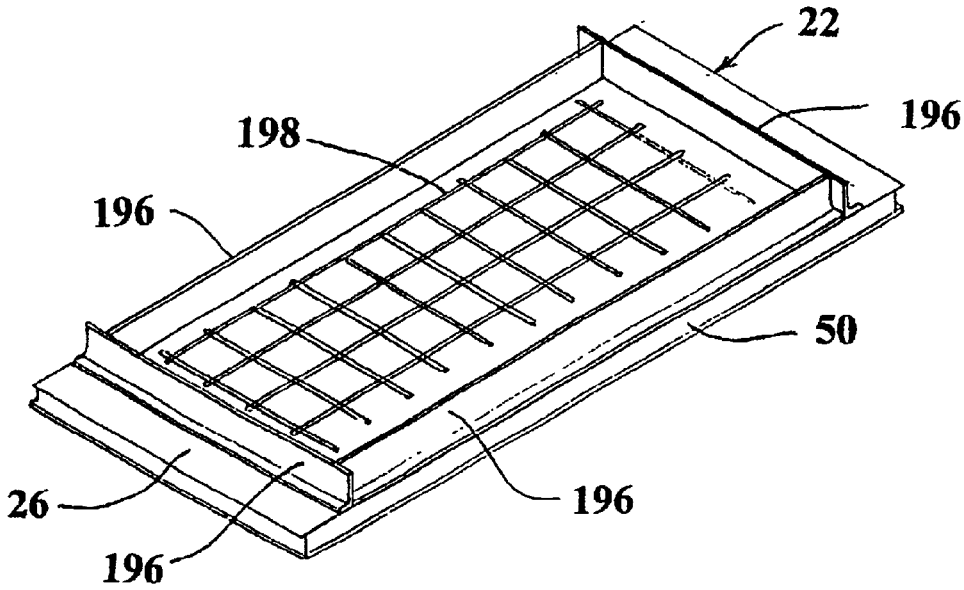
FIG. 10 is a localized perspective view of the table portion of the platform showing the invention in use.

Referring now to FIG. 10, the table 22 of a mobile 20 or stationary 190 manufacturing platform as described above is shown being used for casting a concrete construction component. A mold 196 is assembled on the upper surface 26 of the table 22. Reinforcing bars 198 are installed in the mold prior to pouring concrete.

Figure 11:
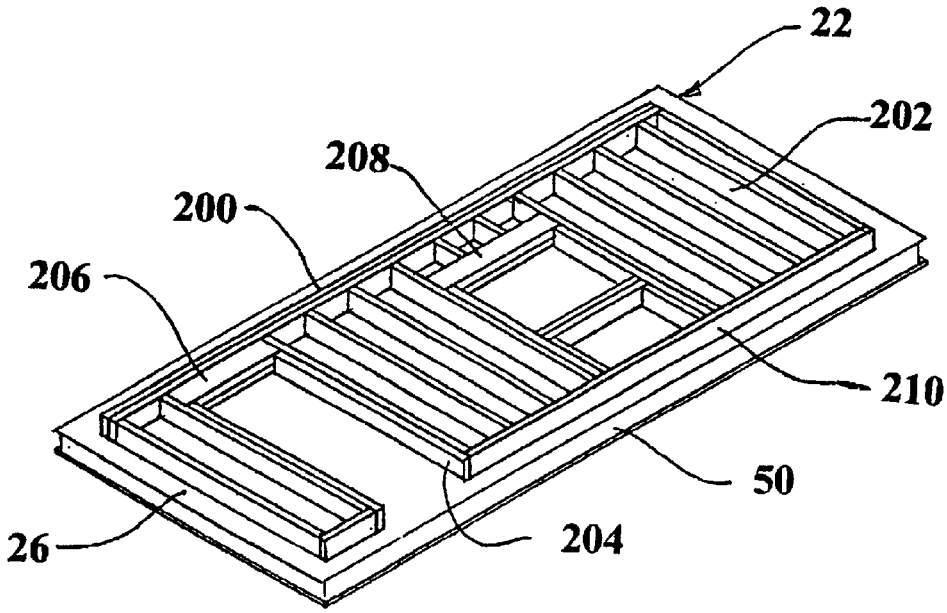
FIG. 11 is a localized perspective view of the table portion of the platform showing another use of the invention.

Turning now to FIG. 11, the table 22 is shown being used to build a wood frame wall. Illustrated are the plate 200, studs 202, liners 204, door header 206, window header 208, and sole 210, which comprise the principal structural members.

It is to be understood that the above detailed description of embodiments of the invention is provided by way of example only. Various details of design and construction may be modified without departing from the true spirit and scope of the invention as set forth in the appended claims.

What is claimed is:

1. A manufacturing platform for producing construction components comprising:

a table having upper and lower surfaces extending between opposite first and second edges and opposite front and rear ends;

a frame extending between opposite first and second edges and opposite front and rear ends;

a first support pivotally attached to the frame adjacent the frame first edge for supporting the frame and allowing the frame to pivot about a first axis;

a second support attached to the frame adjacent the frame second edge for supporting the frame;

the frame second edge being pivotally attached to the table adjacent the table second edge for supporting the table and allowing the table to pivot about a second axis, and the frame rear end being pivotally attached to the table adjacent the table rear end for supporting the table and allowing the table to pivot about a third axis;

locking means for selectively locking the table to the frame to prevent pivotal movement of the table about the second axis and third axes, and releasing the table from the frame to allow pivotal movement of the table about the second axis and third axes; and actuating means for selectively actuating the table and frame together about the first axis to an upright storage position over the first support and to a substantially horizontal operative position wherein the table will be used to manufacture the construction components, with the locking means locked, and for selectively actuating the table about the second axis or third axis to an upright discharge position over the frame second edge or frame rear end wherein the construction component will be removed from the table and to the substantially horizontal operative position wherein the table is closely juxtaposed and substantially parallel with the frame, with the locking means released.

2. The platform of claim 1, wherein the table further comprises a plurality of reinforcing members adjacent the lower surface to limit deflection of the table surfaces.

3. The platform of claim 1, wherein the actuating means is a linear actuator.

4. The platform of claim 1, wherein the second support is selectively variable in height, in order to adjust the table to a level operating position.

5. The platform of claim 1, wherein the first support includes a trailer, comprising:

a chassis extending longitudinally between opposite front and rear ends, the chassis having a left side and a right side, the chassis including at least one longitudinal girder and at least one transverse beam projecting outward from the girder, the transverse beam having an end pivotally engaging the frame on the first axis;

an axle, including a pair of wheels and tires, mounted to the chassis adjacent the chassis rear end; and a hitch mounted on the chassis front end.

6. The platform of claim 1, wherein the second support further comprises:

a first tubular member having at least one transverse hole;

a second tubular member slideably engaging the first tubular member, the second tubular member having a plurality of transverse holes spaced apart longitudinally; and a pin selectively engaging one of the holes in each of the first and second tubular members, in order to adjust the table to a level operating position.

7. The platform of claim 1, wherein the locking means further comprises:

a table locking member attached to the table, the table locking member having a hole therethrough adjacent the table first edge and substantially parallel to the table surface;

a frame locking member attached to the frame adjacent the frame first edge and projecting outward toward the table, the frame locking member having a hole therethrough in alignment with the table locking member hole when the table is in the operative and storage positions; and a locking pin engaging the holes in the table locking member and the frame locking member.

8. The platform of claim 1, further comprising at least one vibrator attached to the table for consolidating concrete.

9. The platform of claim 1, further comprising at least one heater attached to the table for reducing concrete curing time.

10. The platform of claim 1, further comprising a third support attached to the frame adjacent the frame second edge and rear end for supporting the frame and table.

11. A manufacturing platform for producing construction components comprising:

one or more pairs of tables and frames;

each pair of tables, including a right table and a left table, and each table having upper and lower surfaces extending between opposite first and second edges and extending between opposite front and rear ends;

each pair of frames, including a right frame and a left frame, for supporting the right table and the left table, respectively, and each frame including a first edge member extending between opposite front and rear ends, a second edge member extending between opposite front and rear ends, the first edge member being spaced apart from and substantially parallel to the second edge member, a front member extending between the first edge member front end and the second edge member front end, a rear member extending between the first edge member rear end and the second edge member rear end, the front member being substantially parallel to the rear member;

for each pair of frames, a pair of right first supports, including a front right first support pivotally attached to the right frame adjacent the connection of the first edge member to the front end member, and a rear right first support pivotally attached to the right frame adjacent the connection of the first edge member to the rear end member, for supporting the right frame and allowing the right frame to pivot about a right first axis, and a pair of left first supports, including a front left first support pivotally attached to the left frame adjacent the connection of the first edge member to the front end member, and a rear left first support pivotally attached to the left frame adjacent the connection of the first edge member to the rear end member, for supporting the left frame and allowing the left frame to pivot about a left first axis;

for each pair of frames, a pair of right second supports, being selectively variable in height, one support attached to the right frame adjacent the connection of the second edge member to the front end member, and one support attached to the right frame adjacent the connection of the second edge member to the rear end member, for supporting the right frame, and a pair of left second supports, being selectively variable in height, one support attached to the left frame adjacent the connection of the second edge member to the front end member, and one support attached to the left frame adjacent the connection of the second edge member to the rear end member, for supporting the left frame;

each frame second edge member being pivotally attached to the table adjacent the table second edge for supporting the table and allowing the table to pivot about a second axis, and each frame rear end being pivotally attached to the table adjacent the table rear end for supporting the table and allowing the table to pivot about a third axis;

locking means for selectively locking each table to the respective frame, to prevent pivotal movement of each table about the respective second axis, and releasing each table from the respective frame to allow pivotal movement of each table about the respective second axis and third axis;

a right actuating means for selectively actuating the right table and right frame together about the right first axis to an upright storage position over the right first support and to a substantially horizontal operative position wherein the right table will be used to manufacture the construction components, with the locking means locked, and for selectively actuating the right table about the right second axis to an upright discharge position over the right second support wherein the construction component will be removed from the right table and to the substantially horizontal operative position wherein the right table is closely juxtaposed and substantially parallel with the right frame, with the locking means released; and a left actuating means for selectively actuating the left table and left frame together about the left first axis to an upright storage position over the left first support and to a substantially horizontal operative position wherein the left table will be used to manufacture the construction component, with the locking means locked, and for selectively actuating the left table about the left second axis to an upright discharge position over the left second support wherein the construction component will be removed from the left table and to the substantially horizontal operative position wherein the left table is closely juxtaposed and substantially parallel with the left frame, with the locking means released.

12. The platform of claim 11, wherein the right table and the left table each further comprises a plurality of reinforcing members adjacent the lower surface to limit deflection of the table surfaces.

13. The platform of claim 11, wherein the right actuating means is a linear actuator.

14. The platform of claim 11, wherein the left actuating means is a linear actuator.

15. The platform of claim 11, wherein the pair of right first supports and the pair of left first supports includes a trailer, comprising:

a chassis extending longitudinally between opposite front and rear ends, the chassis having two longitudinal girders, including a right girder and a left girder, and two beams attached to the girders transversely, including a front beam extending between the girders and projecting outward from the right girder to a right front beam end, and projecting outward from the left girder to a left front beam end, and including a rear beam extending between the girders and projecting outward from the right girder to a right rear beam end, and projecting outward from the left girder to a left rear beam end, with the right front and right rear beam ends pivotally engaging the right frame on the right first axis, and the left front and left rear beam ends pivotally engaging the left frame on the left first axis;

an axle, including a pair of wheels and tires, mounted to the chassis adjacent the chassis rear end; and a hitch mounted on the chassis front end.

16. The platform of claim 11, wherein each support of the pair of right and left second supports further comprises:

a first tubular member having at least one transverse hole;

a second tubular member slideably engaging the first tubular member, the second tubular member having a plurality of transverse holes spaced apart longitudinally; and a pin selectively engaging one of the holes in each of the first and second tubular members, in order to adjust the table to a level operating position.

17. The platform of claim 11, wherein the locking means further comprises:

a pair of table locking members attached to each table, the table locking members each having a hole therethrough adjacent the table first edge and substantially parallel to the table surface;

a plurality of frame locking members, including one frame locking member attached to each frame front member and to each frame rear member, adjacent each frame first edge member and projecting outward toward the table, each frame locking member being in juxtaposition with one of the table locking members, and each frame locking member having a hole therethrough in alignment with the respective table locking member hole when the table is in the operative and storage positions; and a plurality of locking pins, including one locking pin engaging each table locking member hole and the respective frame locking member hole.

18. The invention of claim 11, further comprising at least one vibrator attached to each table for consolidating concrete.

19. The invention of claim 11, further comprising at least one heater attached to each table for reducing concrete curing time.

20. The platform of claim 11, further comprising:

for each pair of frames, a third support attached to each frame adjacent the frame second edge and rear end for supporting the frame and table.

* * * * *